US005679219A

United States Patent [19]

Harms et al.

[11] Patent Number: 5,679,219

[45] Date of Patent: Oct. 21, 1997

[54] BASE PAPER FOR DECORATIVE COATING SYSTEMS

[75] Inventors: Michael Harms, Bohmte; Christa Schnieder, Amelinghausen; Wolf-Dieter Schroer, Georgsmarienhutte, all of Germany

[73] Assignee: Technocell Dekor GmbH & Co. KG, Osnabruck, Germany

[21] Appl. No.: 539,083

[22] Filed: Oct. 4, 1995

[30] Foreign Application Priority Data

Oct. 5, 1994 [DE] Germany ..... 44 37 118.7

[51] Int. Cl.[6] ..... D21H 17/67

[52] U.S. Cl. ..... 162/164.1; 162/164.3; 162/168.3; 162/181.1; 162/181.6; 162/181.7

[58] Field of Search ..... 162/164.3, 168.3, 162/181.6, 181.7, 183, 181.1, 166, 167

[56] References Cited

U.S. PATENT DOCUMENTS

| | | | |
|---|---|---|---|
| 2,943,013 | 6/1960 | Arledter | 162/181.6 |
| 3,737,371 | 6/1973 | Bazler et al. | 162/181.7 |
| 4,753,710 | 6/1988 | Langley et al. | 162/164.3 |
| 4,913,775 | 4/1990 | Langley et al. | 162/164.3 |
| 4,954,220 | 9/1990 | Rushmere | 162/181.6 |
| 5,185,206 | 2/1993 | Rushmere | 162/168.3 |
| 5,447,604 | 9/1995 | Johansson et al. | 162/181.6 |
| 5,470,435 | 11/1995 | Rushmere et al. | 162/181.6 |
| 5,501,774 | 3/1996 | Burke | 162/181.6 |

FOREIGN PATENT DOCUMENTS

| | | | |
|---|---|---|---|
| 357574 | 3/1990 | European Pat. Off. . | |
| 1156516 | 6/1969 | United Kingdom | 162/164.3 |
| WO922086 | 11/1992 | WIPO . | |

OTHER PUBLICATIONS

JP 2–74695 A. In: Patent Abstracts of Japan, Sect. C, vol.14 (1990), No. 261 (C–725).

*Primary Examiner*—Peter Chin

*Attorney, Agent, or Firm*—Lockwood, Alex, FitzGibbon & Cummings

[57] ABSTRACT

A base paper for decorative coating systems which is made of a paper pulp and contains in addition to cellulose fibers, at least one filler, a wet strength imparting cationic resin, and anionic inorganic particles.

9 Claims, No Drawings

BASE PAPER FOR DECORATIVE COATING SYSTEMS

The present invention relates to a base paper for decorative coating systems, particularly laminates, so called decorative foils and preimpregnated materials.

Laminates are produced by the pressing of impregnated papers which are stacked on top of each other and which generally present a melamine resin or polyester resin surface. This surface can comprise one or more layers and be anchored in different backings. The standard laminate consists only of paper and resin, and the thickness determining backing is made of phenol-impregnated kraft papers. However, it is also known to use different wood materials as sublayers. Hard-fiber and particle boards as well as plywood are used for that purpose.

Paper laminates in general comprise melamine resin coated, transparent overlay paper, melamine resin coated, dyed and/or printed decorative paper, melamine resin coated opaque barrier paper and phenol resin coated kraft paper.

Combined laminates usually comprise overlay paper, decorative paper, barrier paper or kraft papers and hard fiber or particle boards.

Barrier papers are used as barrier layers between phenol papers and the decorative layer to prevent the visibility of the brown core layer and the penetration of the phenol resin into the decorative layer. They are made of highly bleached sulfate or sulfite pulp, and the requirements include a very good opacity, in addition to good wet strength and absorptivity.

Conventional decorative papers are made of highly white sulfate pulp of highest purity. A number of special requirements apply to decorative papers. They include:

high opacity to guarantee a better covering of the backing, even formation and basis weight to guarantee even uptake of the resin, high degree of purity and evenness of the color to guarantee a good reproducibility of the pattern which is later printed onto the decorative paper, high light fastness, high wet strength to guarantee problem-free impregnation processing, and appropriate absorptivity to achieve the required degree of resin saturation.

To fulfill all these requirements, it is necessary to use for the manufacture of these papers high quality raw materials, fillers and auxiliary agents, as well as the suitable production conditions.

The opacity which is important for decorative paper is achieved by using high proportions of filler. Suitable fillers are white pigments, such as zinc sulfide and titanium dioxide. But other fillers can also be used, such as calcium carbonate. Zinc sulfide imparts an excellent light fastness to the paper. However, besides the relatively poor retention of zinc sulfide in paper, there is the additional risk of decomposition accompanied by separation of hydrogen sulfide at the usually acidic pH conditions in the paper pulp.

Of the various titanium dioxide pigments, the rutile type is particularly well suited. Its drawback is its high price. With $TiO_2$ contents of up to 45 wt % in the decorative paper, it is therefore particularly important that a maximum retention of the pigment is guaranteed.

To achieve a good retention of the fillers, different retention agents are added to the paper pulp. Such retention agents include, for example, polyacrylamide (Khim. Perabotka Drevna Ref. Inform. No. 12; 9–10, 1967) and polycarboxylic acids.

The known papers for laminates can be improved as far as the requirements applied to them are concerned. This also applies to the degree of whiteness, opacity and to light fastness.

The problem of the present invention is to create a base paper for decorative coating systems which exhibits excellent properties, particularly insofar as opacity and light fastness are concerned.

In addition, the problem of the invention concerns a proposed method for the manufacture of a base paper for decorative coating systems, which improves the properties described above and by means of which an improved retention of the filler can be achieved.

The term "decorative coating system" includes, in the context of this invention, laminates such as high pressure laminates (HPL), continuous pressure laminates as well as so called decorative foils and preimpregnated materials.

These problems are solved with a base paper which has been made of a paper pulp which contains anionic inorganic particles in addition to at least one filler and a cationic resin which improves wet strength.

The anionic inorganic particles can be selected particularly from the group of colloidal silicic acid, colloidal aluminum modified silicic acid or colloidal sodium or aluminum modified silicate.

The quantity of anionic inorganic particles in the paper pulp can be up to 0.5 wt % in a special variant of the invention. The quantity range 0.01–0.25 wt % is particularly preferred. The indications of quantity refer to the cellulose fiber component.

Suitable fillers are, for example, titanium dioxide, zinc sulfide, calcium carbonate, kaolin, China clay, talc or mixtures thereof.

In a preferred variant of the invention a rutile titanium dioxide with $Al_2O_3$ surface treatment is used.

The quantity of titanium dioxide in the paper pulp is 1–55 wt %, particularly 25–45 wt %.

To impart wet strength it is possible to use melamine-formaldehyde resins, polyamine or polyamide derivatives in quantities of 0.3–2 wt %.

It also is possible to include other substances in the paper pulp, such as organic and inorganic coloring pigments and dyes, optical brighteners and dispersants.

The base papers according to the invention are prepared in the usual manner using a papermaking machine and in a basis weight range of 50–200 g/m$^2$. In the context of the method according to the invention the different components can be added to the pulp suspension in different sequences and at different places as are known to paper manufacturers. To achieve optimal results, in a preferred embodiment of the invention the anionic inorganic particles are introduced into the so called low density pulp before the headbox.

The invention is explained in greater detail in the following examples.

EXAMPLES 1 AND 2

A mixture of 80 wt % hard wood sulfate pulp and 20 wt % soft wood sulfate pulp was ground at a stock consistency of 4% to a freeness degree of 38° SR. The pulp suspension then received additive substances according to Table 1, yielding a base paper with approximately 70 g/m$^2$.

TABLE 1

| Substance | Paper variants, wt %* | | | | | | |
|---|---|---|---|---|---|---|---|
| | 1a | 1b | 1c | 1d | 2a | 2b | 2c |
| Rutile $TiO_2$ d = 3.9 g/cm$^3$ Color index 77891 | 62.0 | 63.0 | 62.0 | 100.0 | 63.0 | 62.0 | 63.0 |
| Polyamide/ polyamine epichlorohydrin resin | 1.05 | 1.05 | 1.05 | 1.05 | 1.50 | 2.00 | 2.65 |
| Anionic Na-mod. silicate | 0.04 | 0.08 | 0.24 | 0.08 | 0.08 | 0.09 | 0.08 |
| Toning dye (iron oxide) | 0.02 | 0.03 | 0.02 | 0.02 | 0.03 | 0.02 | 0.02 |

*The quantities refer to the cellulose.

*Other processing conditions:

Paper machine output 370 m.min pH 6.0–7.0

The tests were also conducted with other pulp suspensions. The effects according to the invention were confirmed again.

COMPARATIVE EXAMPLES V1–V3

The substances as set forth in Table 2 were added to a cellulose suspension, as in Examples 1 and 2:

TABLE 2

| Substance | Paper variants, wt %* | | |
|---|---|---|---|
| | V1 | V2 | V3 |
| Titanium dioxide (Rutile) | 62.0 | 62.0 | 62.0 |
| Polyamide/polyamine epichlorohydrin resin | 1.05 | 1.05 | 1.05 |
| Anionic polyacrylamide | — | 0.20 | — |
| Polycarboxylic acid Na-salt | — | — | 0.20 |
| Toning dye (iron oxide) | 0.02 | 0.02 | 0.02 |

*The quantities refer to the cellulose.

The base papers prepared had basis weights of 60 g/m$^2$.

Testing of the Base Papers Prepared According to the Examples and Comparative Examples Of the paper samples prepared, one portion was left untreated and tested, and another portion was impregnated in a known manner with melamine-formaldehyde resin, pressed to form suitable laminate samples (1 layer of impregnated base paper, 4 layers of phenol paper, 1 layer of backing paper, 140° C., 900 N/cm$^2$) and then examined.

The following testing procedures were used for the evaluation:

Retention (%)

The retention was determined according to the "Britt" dynamic drainage Jahr method (DDJ method) developed by Paper Research Materials, Inc. The testing was conducted on untreated papers.

Light Fastness Test

The molded laminate samples (4.5×10 cm) were exposed to a high-pressure xenon radiation generator (150,000 lux) for a duration of 96 hours using a 1:1 light-dark alternation of exposure to radiation. To evaluate the light fastness, the brightness L was determined on laminate samples according to DIN 6174, before and after the xenon test. The higher the numerical value of L is, the greater the brightness.

The measurements of brightness were conducted using the Elephro 2000 color measuring apparatus (Data Color).

The results of the tests are listed in Table 3. As can be seen in the table, the light fastness (L) of the base papers according to the invention is higher than that of papers without the addition of anionic inorganic particles (Comparative Example V1) or papers with the usual retention agents (Comparative Examples V2 and V3).

It is also possible to achieve an increase in the total retention and thus an improved degree of use of the filler and consequently a cleaner circulation process in the paper manufacture according to the invention.

TABLE 3

Test Results

| Example | Retention | Light Fastness* | | |
|---|---|---|---|---|
| | % | $L_1$ | $L_2$ | ΔL |
| 1a | 57 | 87.16 | 87.08 | −0.08 |
| 1b | 67 | 88.40 | 88.40 | 0.00 |
| 1c | 69 | 88.12 | 88.08 | −0.04 |
| 1d | 68 | 88.10 | 88.05 | −0.05 |
| 2a | 65 | 85.40 | 85.37 | −0.03 |
| 2b | 62 | 84.50 | 84.42 | −0.08 |
| 2c | 60 | 84.52 | 84.49 | −0.03 |
| V1 | 54 | 87.22 | 86.99 | −0.23 |
| V2 | 55 | 87.16 | 86.84 | −0.32 |
| V3 | 55 | 83.68 | 83.38 | −0.30 |

$L_1$ - Brightness before exposure to xenon lamp $L_2$ - Brightness after exposure to xenon lamp

We claim:

1. An absorbent base paper for decorative coating systems, consisting essentially of a cellulose fiber paper pulp; and a) at least one filler of titanium dioxide in the amount of at least about 25wt %;

b) a wet strength imparting cationic resin in the amount of at least about 0.3 wt %; and c) anionic inorganic particles selected from the group consisting of a colloidal silicic acid, a colloidal aluminum modified silicic acid and a sodium or aluminum modified silicate in the amount of at least about 0.01 wt %.

2. The base paper of claim 1, wherein the anionic inorganic particles are present in an amount of up to 0.5 wt % with respect to the cellulose fiber component.

3. The base paper of claim 2, wherein the quantity of the anionic inorganic particles is 0.01–0.25 wt %.

4. The base paper of claim 1, wherein said amount of titanium dioxide is 25–45 wt %.

5. A method for the preparation of an absorbent base paper for decorative coating systems comprising:

forming a paper pulp suspension consisting essentially of cellulose fibers, a filler of titanium dioxide in the amount of at least about 25 wt % of the cellulose fiber component, at least one wet strength imparting cationic resin in the amount of at least about 0.3 wt % of the cellulose fiber component, and anionic inorganic particles selected from the group consisting of a colloidal silicic acid, a colloidal aluminum modified silicic acid and a colloidal sodium or aluminum modified silicate in the amount of at least about 0.01 wt % of the cellulose fiber component; and preparing the paper from the resulting suspension.

6. The method of claim 5, wherein the anionic inorganic particles are added in a low density pulp shortly before the headbox.

7. The method of claim 5, wherein the anionic inorganic particles are added to a high density pulp after thickening.

8. The method of claim 5, wherein the anionic inorganic particles are present in the amount of up to 2.0 wt % with respect to the cellulose fiber component.

9. The method of claim 8, where in the quantity of the anionic inorganic particles is 0.01–0.25 wt %.

* * * * *